United States Patent [19]

Svoboda et al.

[11] Patent Number: 4,892,326

[45] Date of Patent: Jan. 9, 1990

[54] NON-SOLE DEPENDENT SKI BINDING

[75] Inventors: Josef Svoboda, Schwechat; Radko Pavlovec, Wien, both of Austria

[73] Assignee: TMC Corporation, Switzerland

[21] Appl. No.: 116,729

[22] PCT Filed: Feb. 14, 1987

[86] PCT No.: PCT/EP87/00081

§ 371 Date: Dec. 1, 1987

§ 102(e) Date: Dec. 1, 1987

[87] PCT Pub. No.: WO87/04940

PCT Pub. Date: Aug. 27, 1987

[30] Foreign Application Priority Data

Feb. 17, 1986 [AT] Austria ..... 408/86

[51] Int. Cl.[4] ..... A63C 9/082

[52] U.S. Cl. ..... 280/618; 280/620; 280/629; 280/634

[58] Field of Search ..... 280/611, 626, 628, 629, 280/634, 630, 613, 618, 620

[56] References Cited

U.S. PATENT DOCUMENTS

| | | | |
|---|---|---|---|
| 3,432,179 | 3/1969 | Market et al. | 280/630 |
| 4,621,829 | 11/1986 | Krob et al. | 280/628 |
| 4,679,815 | 7/1987 | Pascal et al. | 280/620 |
| 4,732,405 | 3/1988 | Freisinger et al. | 280/628 |

FOREIGN PATENT DOCUMENTS

| | | |
|---|---|---|
| 296111 | 1/1972 | Austria . |
| DE34457-60A1 | 6/1985 | Fed. Rep. of Germany . |
| 1166145 | 11/1958 | France . |
| 2494591 | 5/1982 | France . |
| 2511881 | 3/1983 | France . |
| 2547508 | 12/1984 | France . |

*Primary Examiner*—Charles A. Marmor
*Assistant Examiner*—Richard Camby
*Attorney, Agent, or Firm*—Finnegan, Henderson, Farabow, Garrett & Dunner

[57] ABSTRACT

The invention relates to a safety ski binding and, in particular, to a heel support having a base plate supporting a vertical pivot and fastened to the upper side of a ski. The heel support is equipped with a sole support and with a pivotable support plate, along the heel area of the ski boot. The support plate is pushed into a central position by a spring. In order to shift the axis of rotation of the ski boot in such a ski binding to be substantially in alignment with the extension of the shinbone and to simplify the construction of the ski binding as well, the invention provides that the pivot is disposed between front jaw and heel support of the ski binding. The support plate is pivotably mounted at the pivot and the spring is extended in the longitudinal direction of the ski in the skiing position. The spring acts on a roller. The axle of the roller is guided in a slot in the support plate and anchored in the bearing block of the heel support. A cam is rigidly fastened to the roller. The support plate may also be designed as a sole plate. A stop of the support plate engages at the heel of the ski boot. Alternatively, a stop of the sole plate engages into a groove of the ski boot sole.

13 Claims, 15 Drawing Sheets

NON-SOLE DEPENDENT SKI BINDING

BACKGROUND OF THE INVENTION

The present invention relates to a safety ski binding and, in particular, a ski binding providing an improved heel support.

A typical heel support is described in Austrian Pat. Publication No. AT-A2-296,111. This publication discloses a jaw body, which is rotatably mounted on a pivot in the heel support. A support plate and a sole support are linked eccentrically to the pivot. This design does not take certain geometrical requirements of a ski binding into account. For example, the axis of rotation for a ski boot slipped onto the support plate is not in alignment with the shinbone axis. As a result, the maximum admissible torque of the shinbone cannot be accurately adjusted. In addition, conventional ski bindings generally comprise many parts, thereby requiring excessive time and expense to construct.

German Pat. Publication No. DE-A1-34 45 760 discloses a pivot on a base plate in which the pivot is disposed between a front jaw and a heel support. In this device, the support plate is designed as a continuous sole plate and is pivotally mounted. However, this sole plate is designed in two parts, the first part being mounted at the pivot and the two parts of the sole plate being capable of being pivoted jointly about the pivot. The second part is designed in frame-like fashion relative to the first part and can be additionally pivoted upwardly about a transverse axle mounted in the first part. This design of sole plate is expensive and requires a lot of time and effort to construct.

German Pat. Publication No. DE-A1-23 40 420 discloses control means for pushing the support plate into a central position on the ski. In this publication, a heel support is provided with a spring disposed in the longitudinal direction of the ski and a roller which cooperates with a control cam. However, this heel support does not have any support plate on which the ski boot would be supported with its sole at least in the heel area. Instead, according to this design, a separate plate is provided to mount the heel support which pivots about a vertical axis. The heel of the ski boot is required to rest on a component that is rigidly attached to the ski. The control means thus determines only the pivoting capability of the heel support in the horizontal plate and the ski boot heel rubs against the component rigidly attached to the ski.

German Pat. Publication No. DE-A1-28 51 634 discloses a ski binding in which a roller of the control mechanism is disposed at an element located in parallel with the support plate designed as a base plate. However, the axis of this roller extends transversely to the longitudinal axis of the ski, the roller cooperating with an exposed cam designed in V-shaped fashion. Due to this construction, impurities easily result from snow, ice and the like which prevent precise control of the ski binding.

In another publication, "Tech 60", Technical Manual of Tyrolia 1979, the use of spring force is disclosed in connection with control of a heel support.

SUMMARY OF THE INVENTION

Accordingly, it is an object of the present invention to eliminate the disadvantages of conventional designs and to provide a safety ski binding in which the axis of rotation for the ski boot is approximately along the extended shinbone axis.

The accompanying drawings, which are incorporated in and constitute part of this specification, illustrate one embodiment of the invention and, together with the description, explain the principles of the invention.

DESCRIPTION OF THE PREFERRED EMBODIMENT

Reference will now be made in detail to the preferred embodiments of the present invention, examples of which are illustrated in the accompanying drawings.

Figure 1:
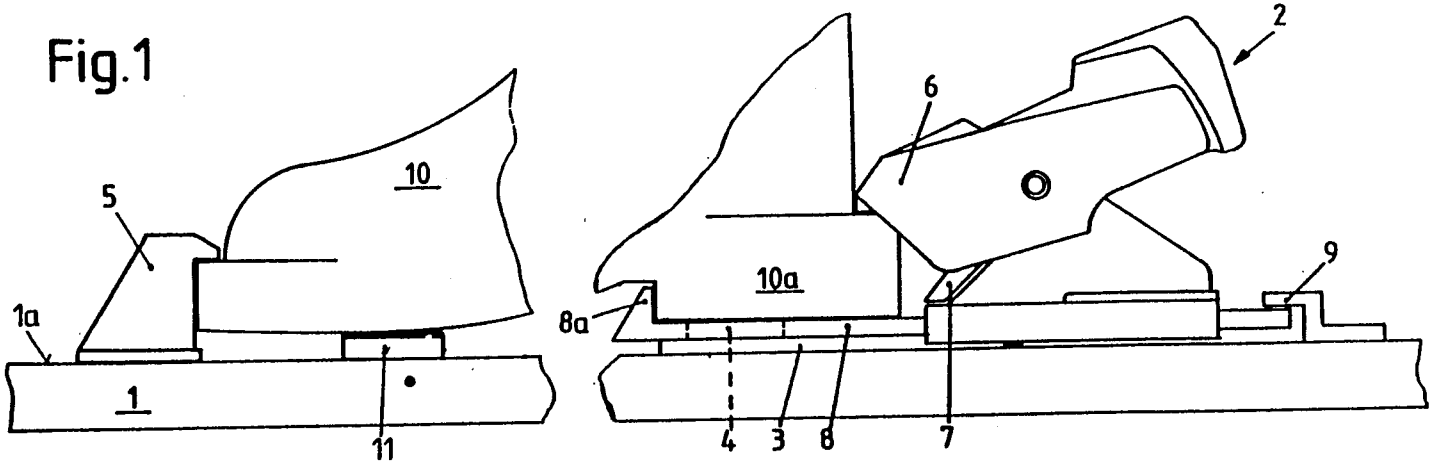
FIG. 1 shows the fundamental construction of a ski binding according to the present invention.
Figure 2:
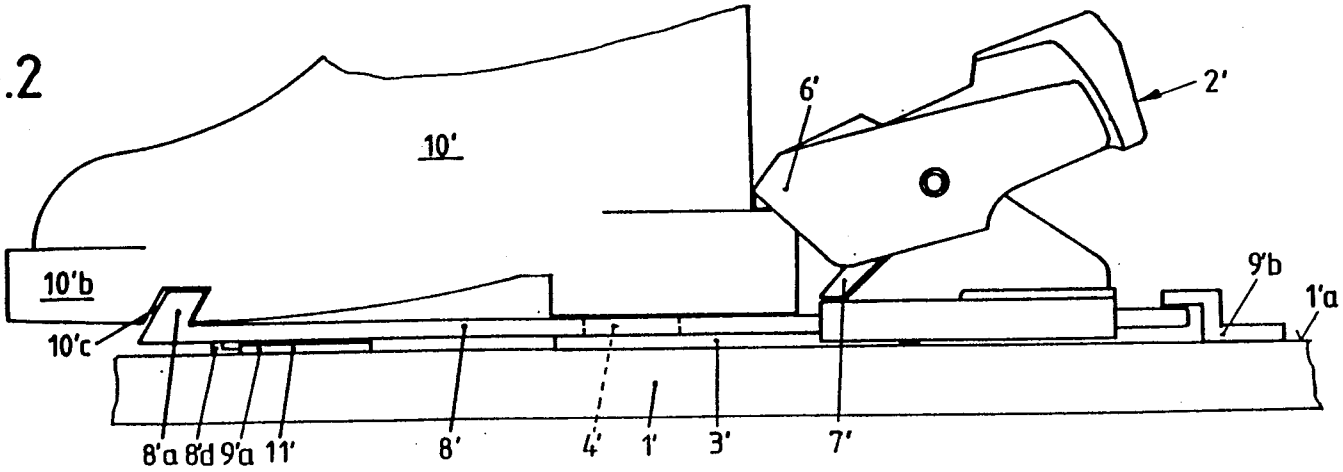
FIG. 2 shows a variation of the embodiment of FIG. 1.

For the sake of clarity, the same reference numerals are used to identify similar components of each of the individual embodiments, however incremented in hundreds, with the exception of FIG. 2. In FIG. 2, the same reference numerals as in FIG. 1 are used but have an asterisk to differentiate this embodiment from the embodiment of FIG. 1.

According to the present invention, as embodied herein and shown in FIG. 1, a ski is designated generally by reference numeral 1 and includes a front jaw 5 and a heel support. The heel support is fastened to the upper side 1*a* of the ski by means of a base plate 3 which is provided with a vertical pivot 4 and is equipped with a sole holding portion 6 and with a tread spur 7. A support plate 8 is pivotally mounted on the pivot 4, on which the heel support 2, which is displaceably guided in the longitudinal direction, is mounted. The end of the support plate 8 is secured against lifting from the upper side 1*a* of the ski 1 by a securing means 9. A stop 8*a* for the lug 10*a* of the ski boot 10 is located at the front end of the support plate 8 and the front jaw 5 holds down the ski boot sole. The front end of the sole of the ski boot 10 rests on the base plate 11 which is designed as a slide plate and is produced of low-friction material or has at least such a material or coating of material on its upper side. The support plate 8 is kept in its central position in a manner to be described in detail with reference to FIG. 3.

As embodied herein, FIG. 2 differs from the embodiment represented in FIG. 1 in that the support plate extends towards the tip of the ski and forms a type of sole plate 8'. The stop 8'*a* extends within a groove 10'*c* of the sole 10'*b* of the boot 10'. A base plate 11' of low-friction material is fastened to the upper side 1'*a* of the ski 1', which has a securing means 9'*a*. An extension 8'*d* having a guide and designed at the front end and at the lower side of the sole plate 9' is engaged with the securing means 9'*a*.

In accordance with the present invention, the function of the ski binding illustrated in FIGS. 1 and 2 is fundamentally the same. The release of the ski boot 10, 10' is initiated in the case of a pure forward, a pure torsion fall or a combined forward torsion fall by the skier. In the case of a forward fall of the skier, the heel support 2 opens in known fashion. In the case of a torsion fall, the support plate 8 or the sole plate 8' is pivoted about the pivot 4. The heel support 2 is displaced relative to the support or sole plate 8, 8' in its longitudinal direction and released by a control mechanism, which will be described later.

As embodied herein and shown in FIGS. 3–7, the heel support 102 includes a base plate 103 and a holding means 109 fastened to a ski 101. The base plate supports a pivot 104 extending vertically from the upper side of the ski on which a support plate 108 is pivotally mounted. The base plate 103 has a cam 103*a* at its rear end. The support plate 108 is secured at its rear end against a lifting from the upper side of the base plate 103 by the securing means 109.

In accordance with the present invention, the support plate 108 supports at its front end a stop 108*a* for the heel of the ski boot and two bearing lugs 112 in its central area. Two oblong holes 113 and 114 are recessed in the support plate 108 and located one behind the other in a radial direction. The front oblong hole 113 is traversed by a vertical axle 115, which projects downwardly and is fastened to a bearing block 116 of the spring housing 118 of a heel support 102. A roller 119 is mounted on the axle 115, which rolls on the cam 103*a* of the base plate 103 upon a torsion fall of the skier. The bearing block 116 supports furthermore a downwardly directed lug 120 which engages into the rear oblong hole 114 and is loaded by a pressure spring 121, which urges the bearing block 116 against the pivot 104.

According to the present invention, the bearing block 116 has a base 116*a* which is guided at the support plate 108 and encloses the same at its two sides and on which two upwardly projecting lets 116*b* are disposed, between which the spring housing 118 is pivotally mounted on two half-axles 118*b*. Two parallel oblong holes or slots 116*e* extend substantially in a radial direction of the support plate 108. The slots 116*e* are open towards the pivot 104 and are recessed in the base 116*a*. The slots 116*e* are traversed by bearing lugs 122 disposed at the support plate 108. These bearing lugs 122 are connected by two articulated brackets 123 to the spring housing.

A slide 124 which is loaded by a pressure spring 125 is guided in the longitudinal direction of the spring housing 118. The spring housing 118 is traversed by an axle 118*a* for the sole holding portion 106, which is fastened in the bearing block 116 and passes through guide slots of the spring housing and a recess of the slide 124. The two half-axles 118*b* are at a distance from the axle 118*a*. The slide 124 rests with a nose at its front side against a cam 106*a*, which is recessed in the interior of the sole support 106.

Figure 3:
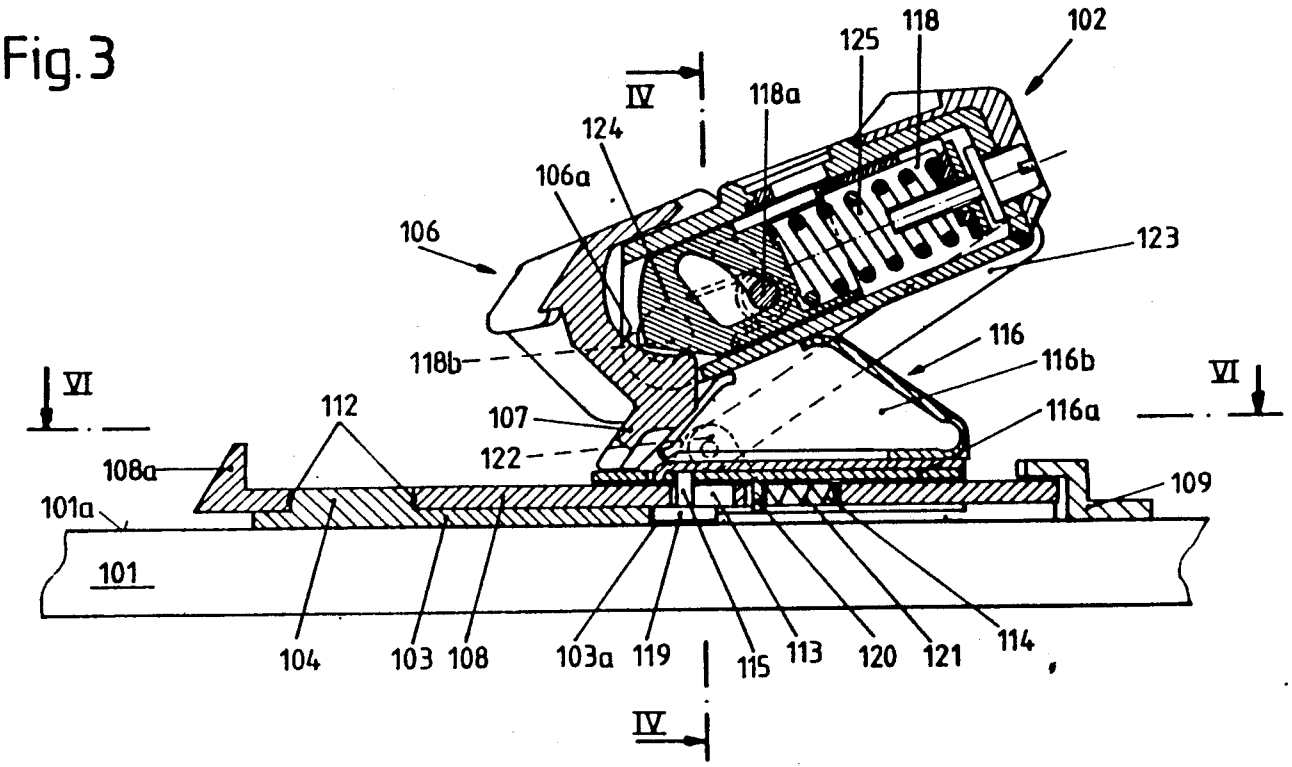
FIG. 3 is a partially sectioned lateral view of a heel support according to the present invention.
Figures 4, 5:
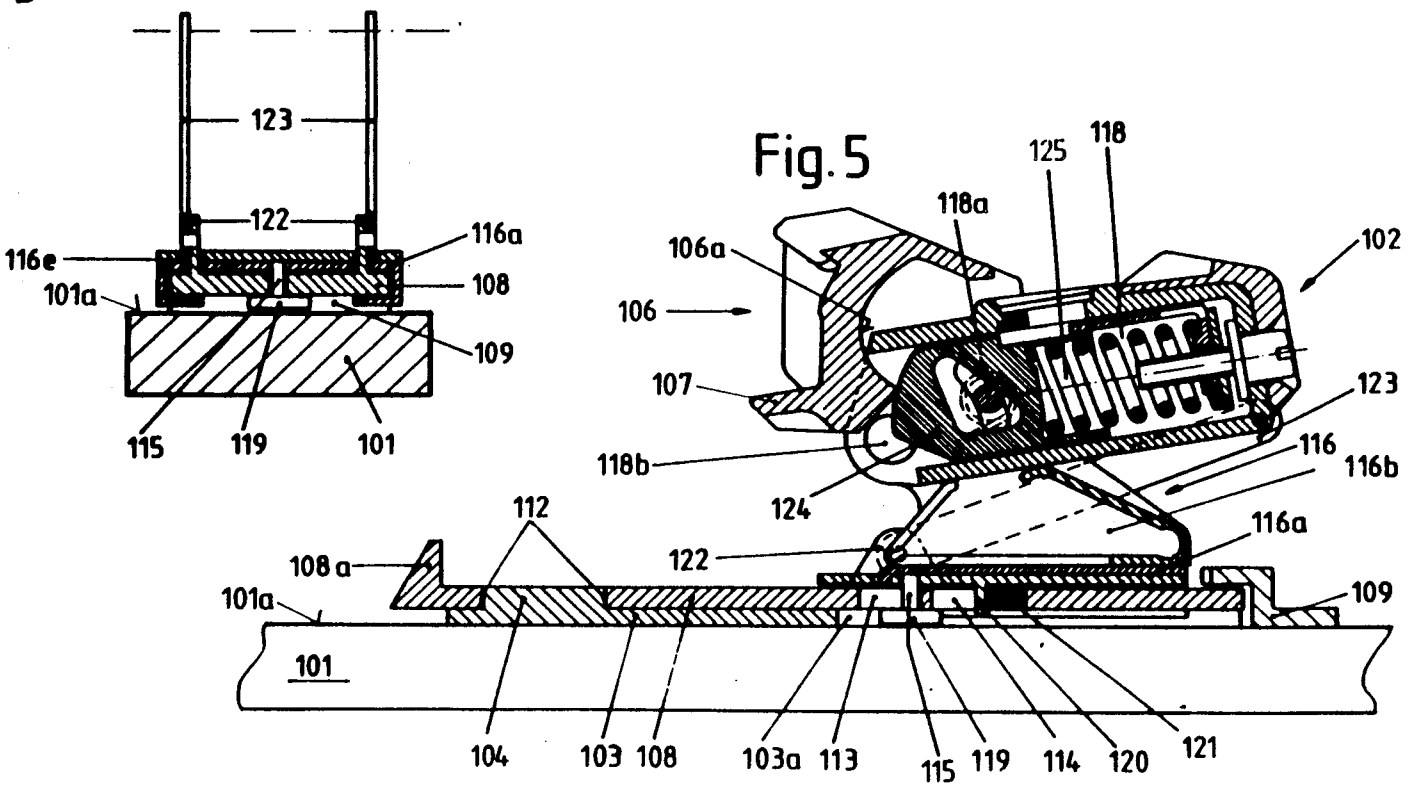
FIG. 4 is a section along the line IV—IV in FIG. 3 (details of the spring housing are omitted).
FIG. 5 shows a heel support after a torsion fall of the skier.
Figure 6:
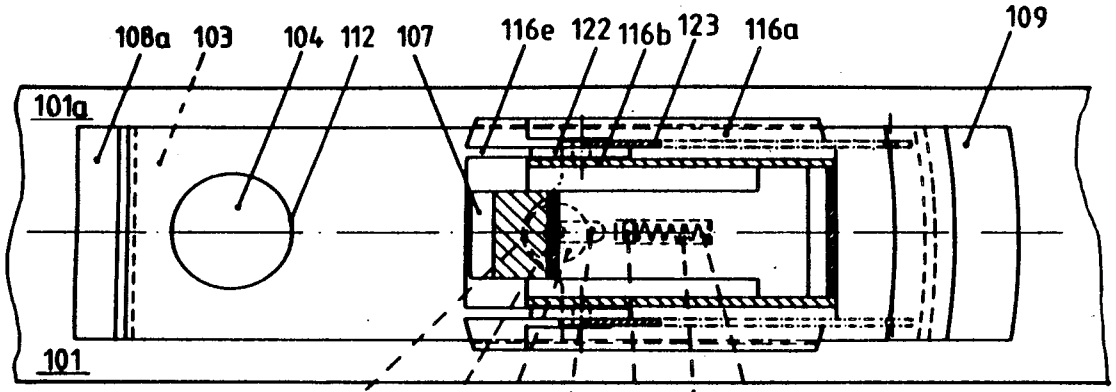
FIG. 6 is a sectional view taken along the lines VI—VI of FIG. 3.

In accordance with the present invention, in the skiing position the heel support 102 adopts the position represented in FIG. 3, in which the heel of the ski boot is retained between the stop 108*a* and the sole hold portion 106. If there is a frontal fall of the skier, the sole hold portion 106 is pivoted upwardly together with the tread spur 107 and the pressure spring 125 located in the spring housing 118 is pressed together by the slide 124 as is generally known.

Figure 7:
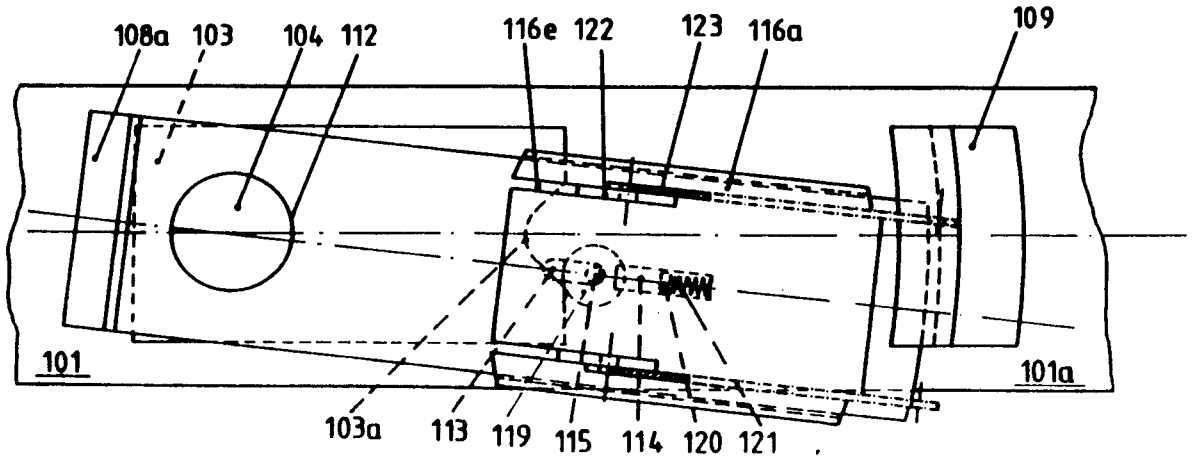
FIG. 7 is a simplified sectional view taken through the heel support after a torsion fall of the skier.

In the event of a torsion fall, on the other hand, the support plate 108 is pivoted about the pivot 104, as shown in FIG. 7. The roller 119 rolls on the cam 103*a* of the base plate 103. At the same time the bearing block 116 which is guided at the support plate 108 in the longitudinal direction of the same is pressed rearward against the force of the pressure spring 121. The two articulated brackets 123 in FIG. 3 are pivoted clockwise, because the bearing lugs 122 are fastened to the support plate 108, while the spring housing 118 is moved towards the rear. The spring housing 118 is therefore also pivoted clockwise with respect to the bearing block 116. The axle 118*a* is positioned at the upper end areas of the guide slots of the spring housing 118 and the recess of the slide 124. The spring housing 118 is therefore displaced towards the end of the ski, the pressure spring 125 being compressed. The nose of the slide 124 then releases the sole support 106, which can swing towards the heel of the ski boot. After the release of the boot, the support plate 108 swings back into its central position under the action of the pressure spring 121. As such, the two branches of the cam 103 can extend in V-shaped fashion in the top view.

Figure 8:
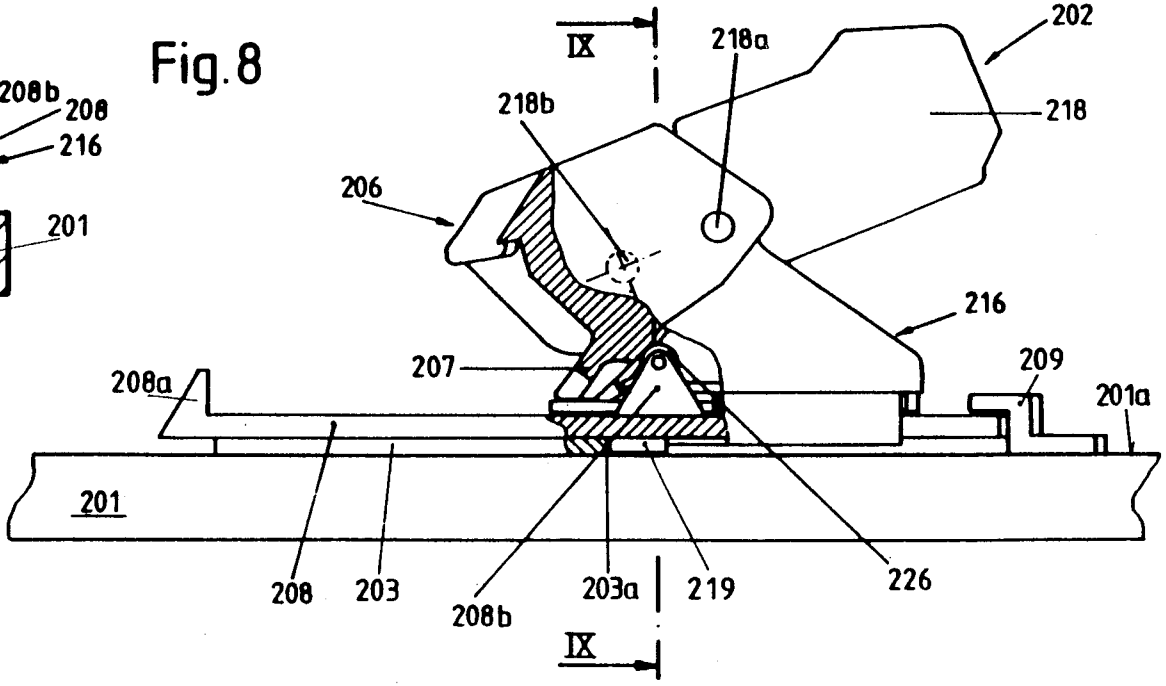
FIG. 8 is a partial section taken along line VIII—VIII in FIG. 9.
Figure 9:
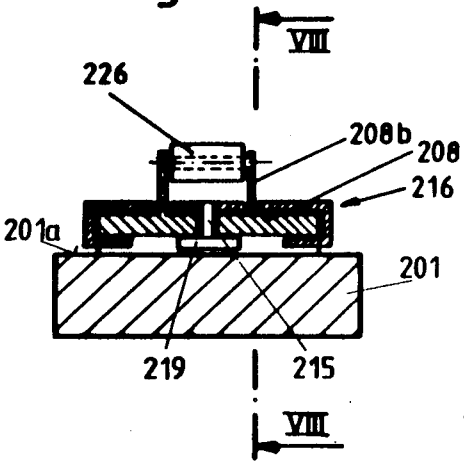
FIG. 9 is a section taken along line IX—IX of FIG. 8.

In accordance with the present invention, the heel support 202 represented on the ski 201 in FIGS. 8 and 9 is similar to that which has been previously described. A roller 226 is mounted between the two upwardly projecting legs 208*b* of the support plate 208 in the heel support 202. The roller 226 supports itself on the lower side of the tread spur 207, which can be pivoted together with the sole support 206 about the axle 218*a* with respect to the bearing block 216. The spring housing 218 is mounted at half-axles 218*b*, which extend in parallel to the axle 218*a*. A pivoting of the spring housing 218 only takes place in the case of an arbitrary opening of the heel support.

In the case of a frontal fall, the sole support 206 is swung upwardly about the axle 218*a*. In the case of a torsion fall, the bearing block 216 is displaced towards the rear in the longitudinal direction of the support plate 208 against the force of the pressure spring (not shown here). The roller 226 lifts the tread spur 207 and the sole support 206 until the ski boot is released.

Figure 10:
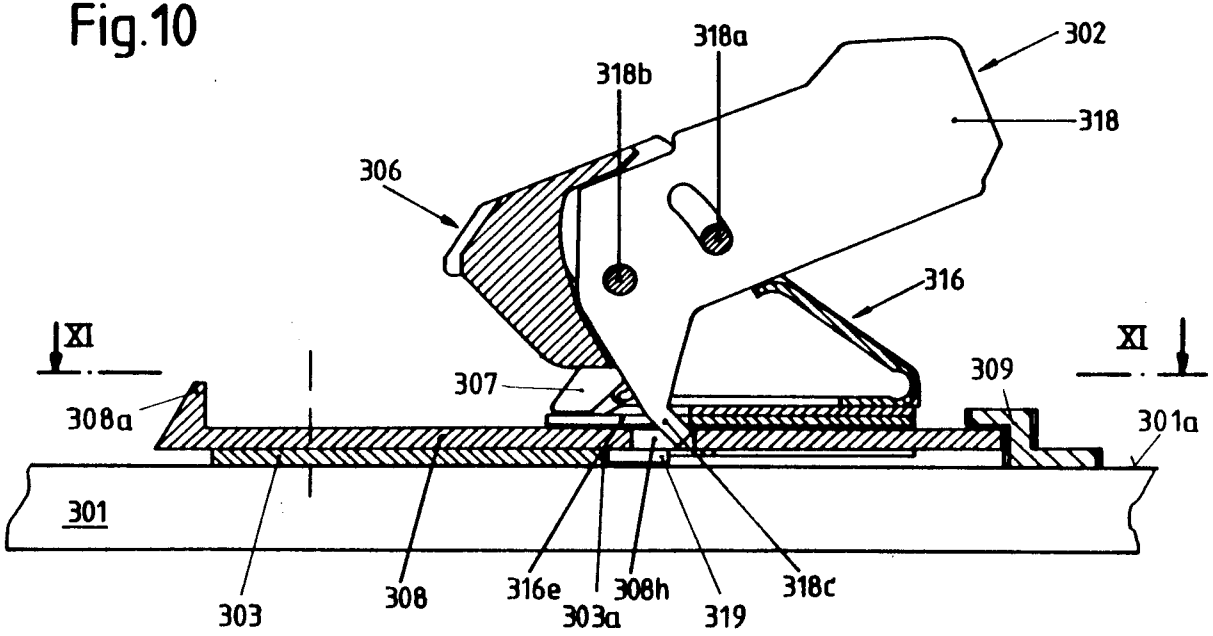
FIG. 10 is another embodiment and is represented as a section along the line X—X in FIG. 11.
Figure 11:
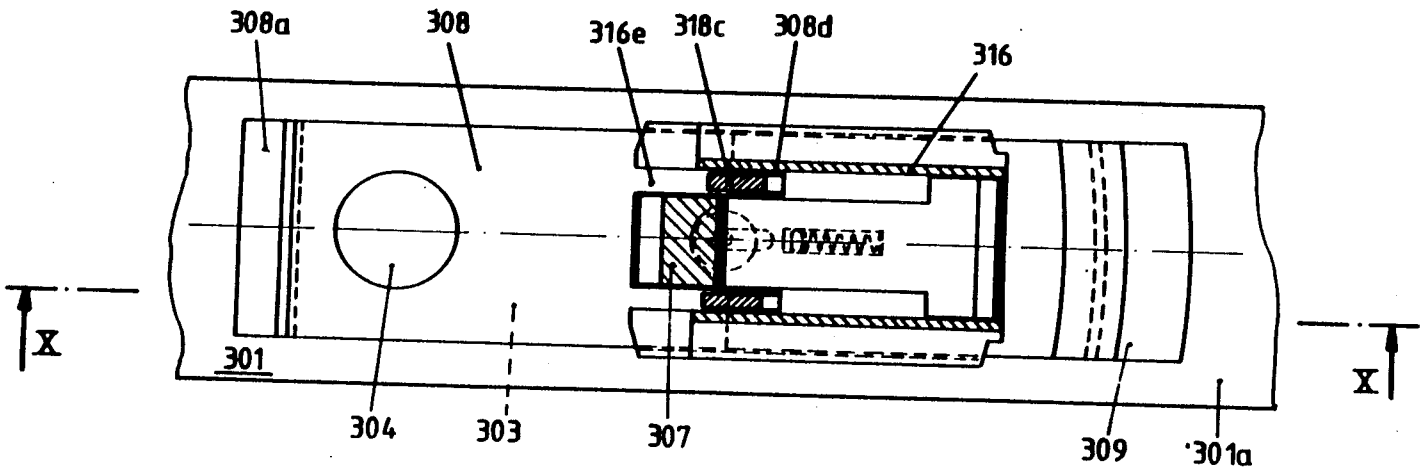
FIG. 11 shows a section along the line XI—XI of FIG. 10.

In accordance with the present invention, the embodiment shown in FIGS. 10 and 11 differs from the preceding embodiments in the following way. Essentially, the spring housing 318, which is mounted in the bearing block 316 on half-axles, has two downwardly directed lugs 318*c* which are disposed symmetrically with respect to the vertical longitudinal central plate. The lugs 318*c* engage into vertical extending recesses 308*h* of the support plate 308 and traverse slots 316*e* in the bearing block 316.

In the case of a torsion fall of the skier, the bearing block 316 is also displaced towards the rear in the longitudinal direction of the support plate 308. Since the lugs 318*c* are held by the support plate 308 at their ends, the spring housing 318 carries out a pivot movement which is clockwise in the representation according to FIG. 10. The sole support 306 is released and the ski boot (not shown) can leave the heel support 302 disposed on the ski 301.

Figure 12:
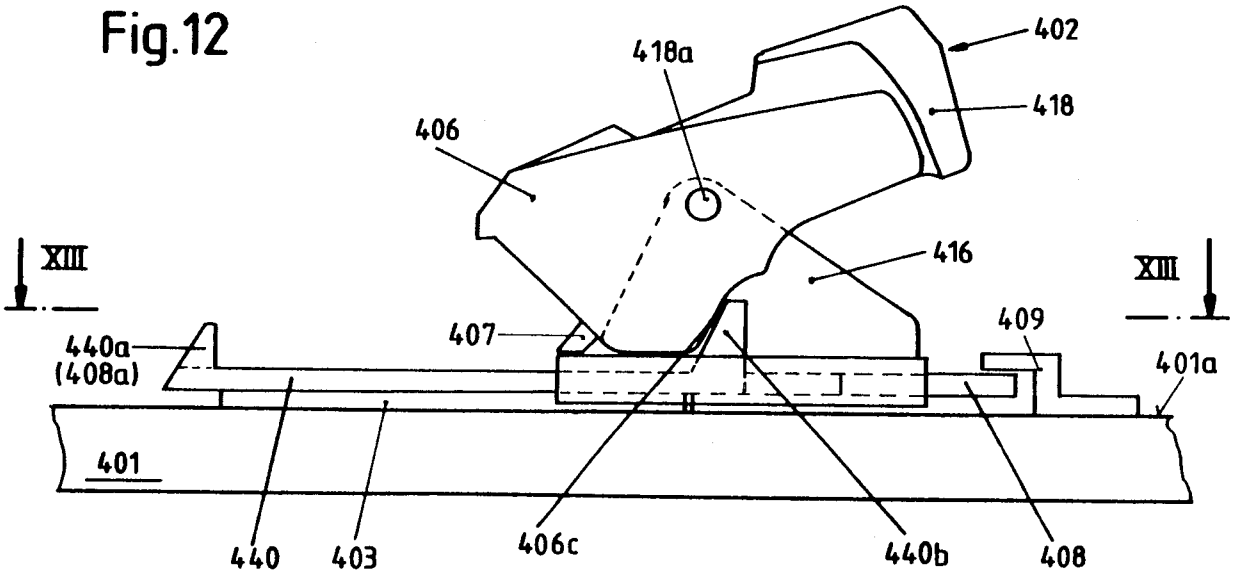
FIGS. 12–14 illustrate another embodiment of a heel support, which is shown as a lateral view or as a section along the line XIII—XIII of FIG. 12 and as a section along the line XIV—XIV in FIG. 13.
Figure 13:
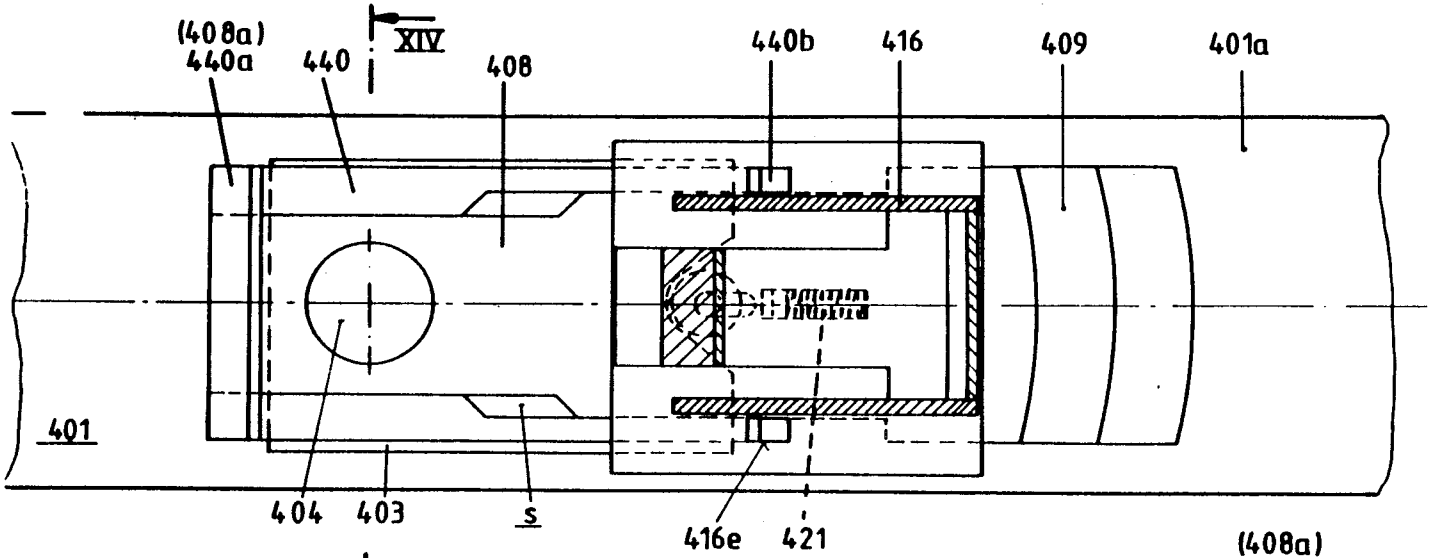
Figure 14:
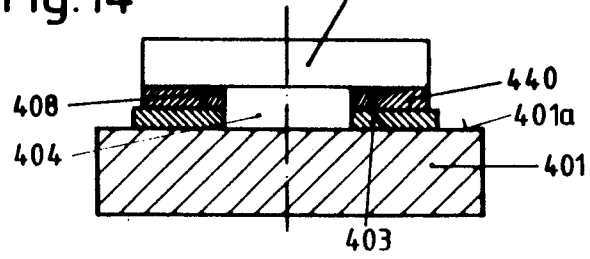

As embodied herein and shown in FIGS. 12–14, the heel support 402 disposed on the ski 401 and the heel of the ski boot is under a spring bias acting on the front side of the heel. According to this embodiment, the stop 408*a*, which holds the heel of the ski boot, is formed by an upwardly projecting extension 440*a* of the slide 440. The slide 440 is guided on the support plate 408 in its longitudinal direction, as shown in FIG. 14, by means of a dovetail guide. This slide 440 has two upwardly projecting lugs 440*b*, which rest against two stop surfaces 406*c* of the sole support 406. The lugs traverse slots in the bearing block 416. The bearing block 416, which receives the spring housing 418, is acted upon by the thrust spring supported on the one end of the support plate 408. The thrust spring is designed as a pressure spring. The slide 440 and thus also the extension 440*a* acting as stop 408*a* are under spring bias via the two stop surfaces 406*c*. Due to an adapted length dimension of the lugs 440*b* and the slots 416*c* in the bearing block 416, an exact return of the slide 440 can also be ensured. The two lugs 440*b* rest preferably tightly against the associated rear limiting wall of the individual slots 416*e*. The support plate 408 is stopped towards its longitudinal axis both in the area of the pivot 404 and in the area of lugs 440*b* to guide the slide 440. The bearing block 416 including recesses on both sides in the first-mentioned stepped area of the support plate 408 for the longitudinal adjustment of the slides 440.

In the skiing position, the heel of the ski boot is held between the extension 440*a* and the sole support 406, and is also maintained in the elasticity area of the heel support 402. The extension 440*a*, as already mentioned, participates in the longitudinal movements of the heel support 402 via the slide 440. The control of the release function and the release of the ski boot are effected in the fashion previously described.

Figure 15:
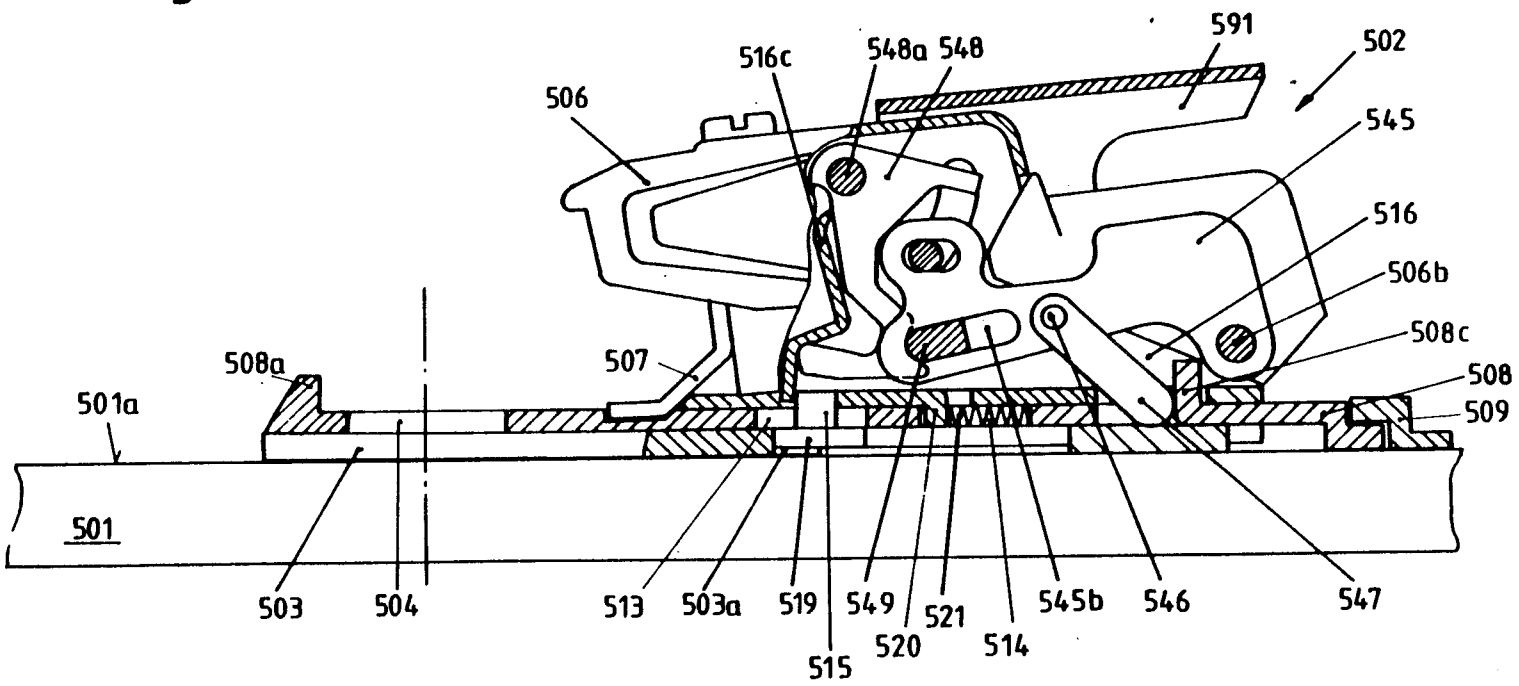
FIGS. 15 and 16 show two further embodiments of heel supports which are equipped with a spring fork.

In accordance with the present invention, another embodiment includes a heel support 502 mounted on ski 501, as shown in FIG. 15. This embodiment includes a sole 506, which is mounted pivotally about an axle 506*b* in the bearing block 516. A spring fork 545 is also mounted on this axle 506*b*. The bearing block 516 has a front wall 516*c*, against which the end of a locking lever 548 mounted on the sole support 506 on an axle 548*a* rests. This locking lever 548 is acted upon by a pressure element 549 at its rear side, which is guided in slots 545*b* of the spring fork 545 and acted upon by a locking spring (not shown). The heel support 502 is provided with a release lever 591, which can be pivoted about the same axle 548*a* as the locking lever 548. A support link, designated as lever 547, is linked to the spring fork 545 by means of an axle 546, which is supported on a lug 508*c* of the support plate 508.

In the event of a frontal fall, the locking lever 548 in FIG. 15 slides along the front wall 516*c* of the bearing block until the ski boot is released. To make re-entry of the skier with the ski boot possible, the locking lever 548 is held by a catch in the opened position of the heel support 502.

In the event of a torsion fall of the skier, the roller 519 rolls at the cam 503*a* of the base plate 503. The result of this is that the bearing block 516 is displaced towards the rear against the force of the pressure spring 521. As a result, the support 547 is pivoted clockwise, whereby the pressure element 549 is lifted out from the rear groove of the locking lever 548 and the sole support 506 can be pivoted clockwise.

Figure 16:
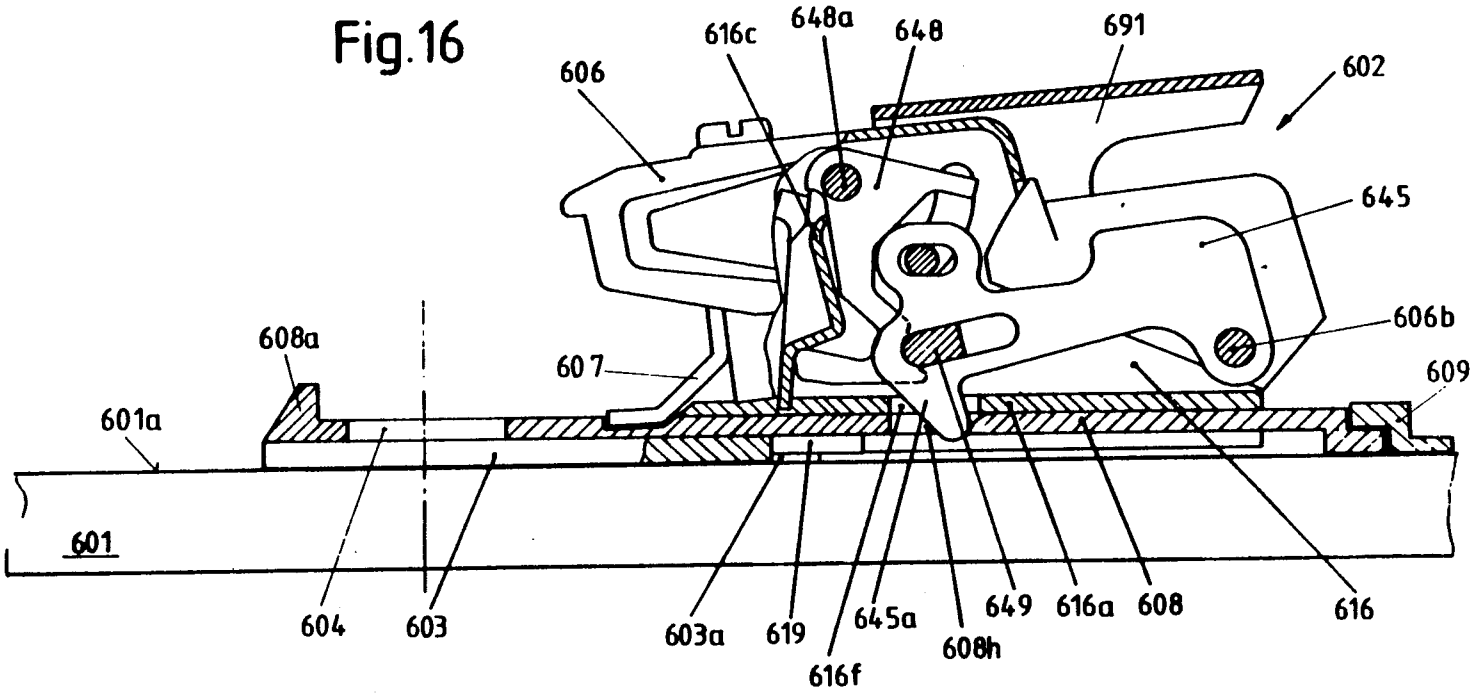

As embodied herein and shown in FIG. 16, a heel support 602 is mounted on a ski 601. It is simplified with respect to the embodiment of FIG. 15, inasmuch as two lugs 645*a* are disposed at the spring fork 645, which point downwardly. These lugs 645*a* traverse oblong holes 616*f* in the base 616*a* of the bearing block 616 and engage into recesses 608*h*, which are recessed in the support plate 608.

Operation of this embodiment in event of a frontal fall may be understood from consideration of the previous description with respect to other embodiments. In the case of a torsion fall of the skier, the bearing block 616 is displaced towards the rear of the support plate 608 by the roller 619 mounted on it, which rolls at the cam 603*a* of the base plate 603. As a result, the spring fork 645 is pivoted clockwise about the axle 606*b*, which results in a lifting of the pressure element 649 out of the groove at the rear side of the locking lever 648 mounted on the axle 648*a*. Thus, the locking lever 648 can be lifted from the front wall 616*c* of the bearing block 615 without any force. Due to this, the sole support 606 can pivot into its opened position.

Figure 17:
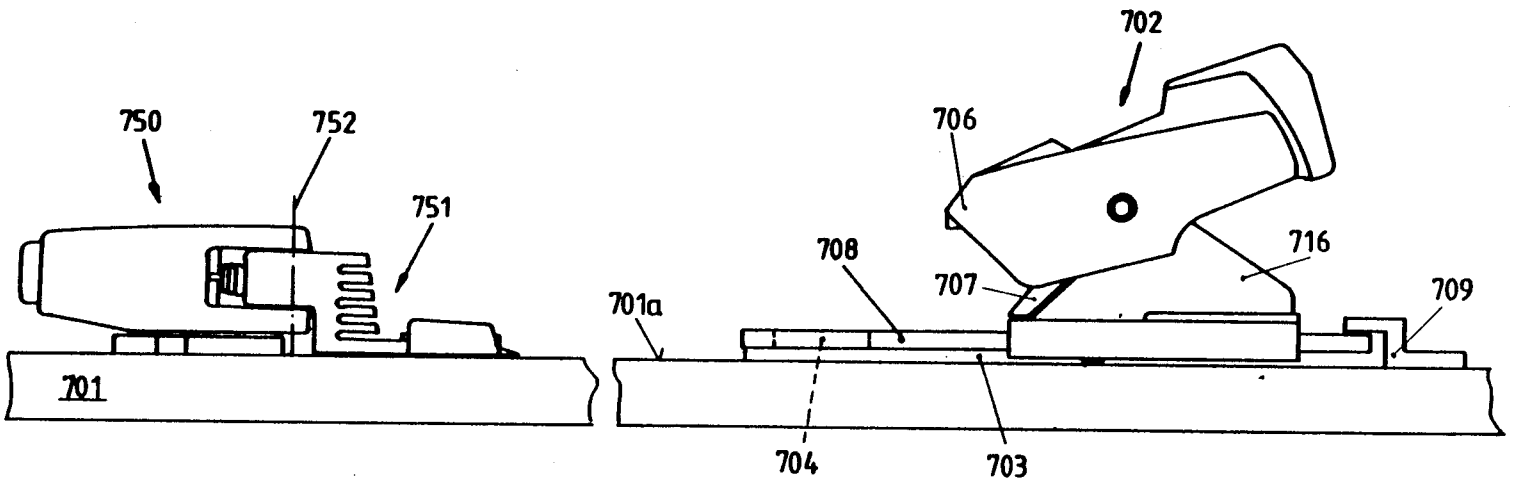
FIGS. 17–19 illustrate another embodiment of a ski binding represented as a lateral view or a partially sectioned elevation (both views in the skiing position) and in a partially sectioned elevation in the case of a torsion fall of the skier.
Figure 18:
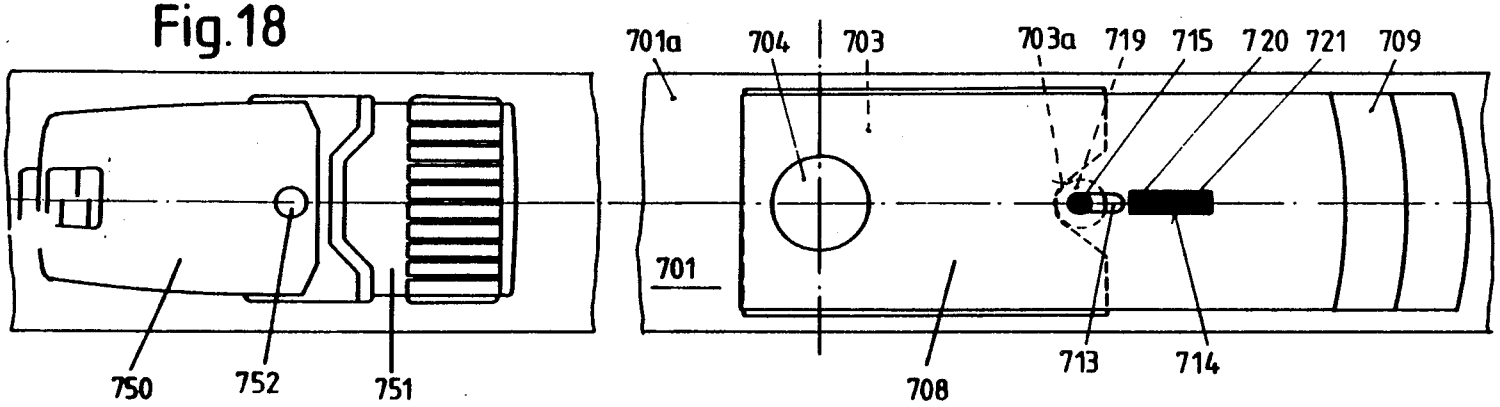
Figure 19:
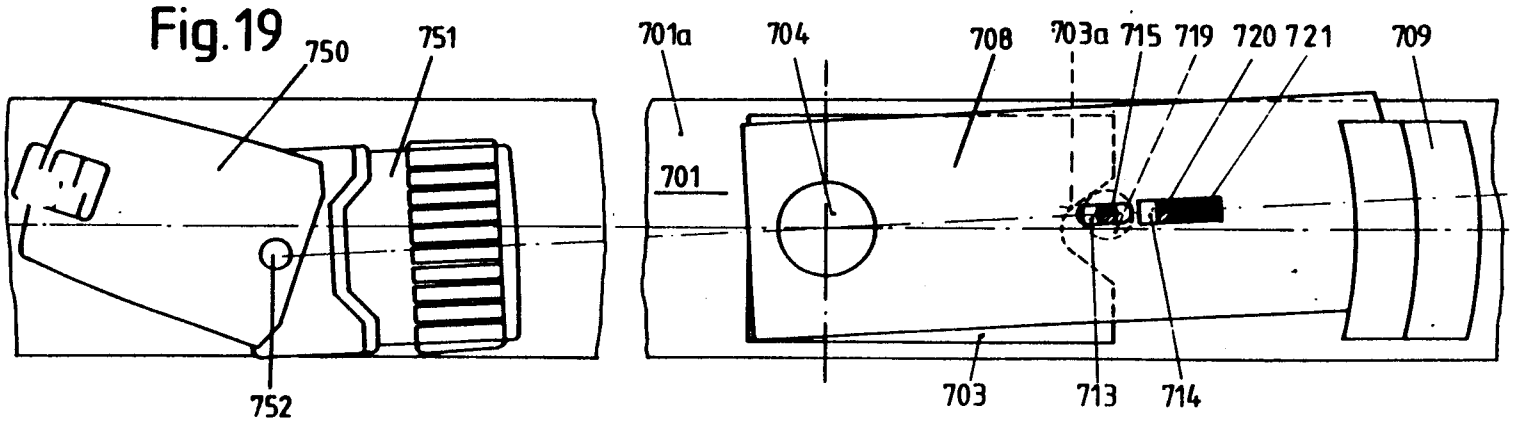

In accordance with the present invention, the embodiments shown in FIGS. 17 and 19 differ from the preceding embodiment primarily because the heel support 702 is disposed on a support plate 708 having a planar design and without a stop for the heel of the ski boot. For this reason, a front jaw 750 is allocated to the heel support 702 on the ski 701, which is equipped with a support plate 751 for the tip of the ski boot. As is apparent from FIGS. 18 and 19, the support plate 751 with the sole of the ski boot (not shown) pivots so that no relative movement, and thus no friction, occurs between the sole and the support plate 751. The change of the position of the support plate 751 is effected relative to the front jaw 750 about an axle 752. The heel support 702 may be designed according to one of the embodiments previously described.

Figure 20:
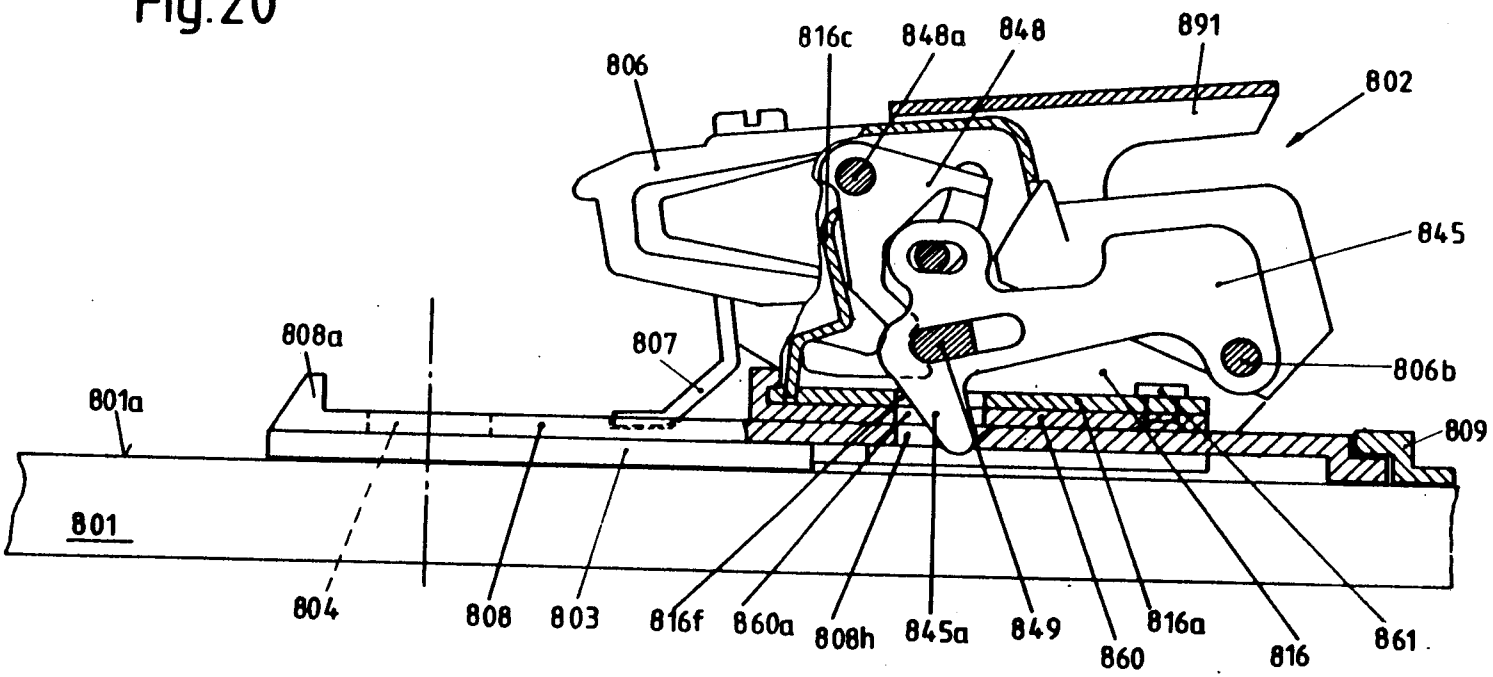
FIG. 20 shows an embodiment similar to FIG. 17, however with a heel support implementing a controlled diagonal release.

The heel support 802 disposed on the ski 801 shown in FIG. 20 corresponds substantially to the embodiment represented in FIG. 16. The principal difference between FIGS. 16 and 20 relates to carriage 860, which is mounted on the support plate supporting at its rear end a vertical axial member 861 for the bearing block 816.

While skiing, the two lugs 845*a* of the spring fork 845 traverse oblong holes 816*e* in the base 816*a* of the bearing block 816 and oblong holes 860*a* in the carriage 860 and recesses 808*h* in the support plate 808. In the case of a torsion fall, the carriage 806 is displaced towards the rear on the support plate 808. As a result, the pressure element 849 is lifted out of the groove at the rear side of the locking lever 848 mounted on the axle 848*a*. The spring fork 845 is subject to the influence of a spiral spring (not shown) which is disposed on the axle 806*b* for the sole support 806 into a position in which the two lugs 845*a* of the spring fork 845 already have left the oblong holes 860*a* or the recesses 808*h* in the carriage 860 or in the support plate 807. As a result, the bearing block 816 may pivot about the vertical axis 861, which facilitates a release of the ski boot in the case of a fall, as is customary in heel supports with a controlled diagonal release.

Figure 21:
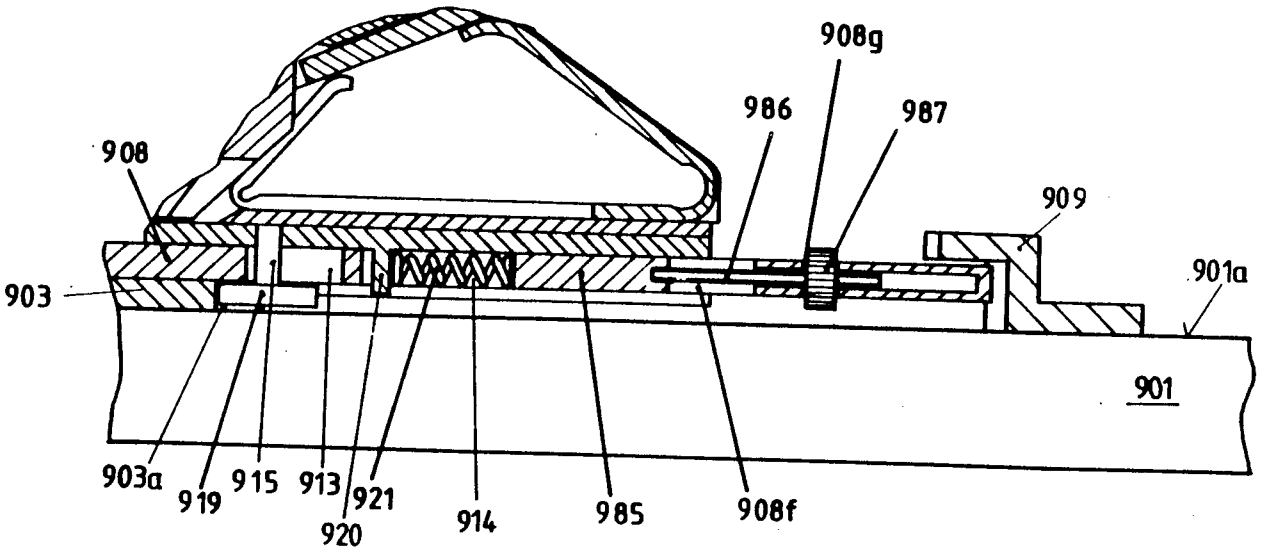
FIG. 21 is a detailed illustration of a longitudinal central section of the ski binding.

FIG. 21 illustrates another embodiment of a ski binding of the present invention. In this embodiment, the pressure spring 921 acts upon the roller 919 and is supported on its end remote from the roller by a spring abutment in the form of a piston 985. The piston 985 is guided in a slot 908*f* of the support plate 980 or sole plate to prevent twisting. A gudgeon 986 is fastened with its one end to the piston 985, on which a knurled nut 987 is screwed. The same nut 987 is rotatable in a further slot 980*g* of the support plate 908, but is mounted secured against axial adjustment. If the bias of the pressure spring 921 requires adjustment, the knurled nut 987 is rotated in the corresponding direction of rotation.

It will be apparent to those skilled in the art that modifications and variations can be made in the safety ski binding of the present invention without departing from the scope and spirit of the invention. For example, the heel support of FIGS. 3 to 7 may also be used in connection with a sole plate as it is represented in FIG. 2. It also is possible to replace the heel support in the embodiment of FIGS. 17 to 19 by one of the heel supports according to FIGS. 8, 10, 15, 16 or 20. Further, the helical spring used for pressing the roller against the cam of the base plate may be replaced by a disk spring assembly. Therefore, it is intended that the present invention cover similar modifications and variations provided that they come within the scope of the appended claims and their equivalents.

What is claimed is:

1. A safety ski binding for releasably securing a ski boot to a ski having a tip end and a rear end, the binding comprising:

an elongated base plate having a first surface disposed to be mounted on a ski, a second surface opposite said first surface, and a cam surface disposed on an edge of said base plate:

a pivot axle extending from said second surface of said base plate;

an elongated support plate pivotably mounted on said base plate about said pivot axle, said support plate having an oblong cam axle opening and an oblong lug opening, said openings extending in the longitudinal direction of the support plate;

a heel support having a bearing block portion and a sole holding portion pivotably mounted on said bearing block portion for pivotal movement between a sole locking and a sole releasing position, said bearing block portion mounted on said elongated support plate for longitudinal movement along said support plate, said heel support including a cam axle extending through said cam axle opening and a lug extending through said lug opening;

a cam roller disposed on said cam axle for rolling engagement with said cam surface of said base plate, said cam roller and said cam surface cooperating to move said heel support in the direction of the rear end of said ski when said sole plate is pivoted about said pivot axle; and spring means disposed between an edge of said lug opening and said lug for biasing said cam roller against said cam surface.

2. A safety ski binding as set forth in claim 1, further comprising means for connecting said support plate with said sole holding portion of said heel support and for pivoting said sole holding portion to said released position in response to movement of said heel support towards the rear end of the ski.

3. A safety ski binding as set forth in claim 2, wherein said connecting means includes at least one elongated bracket pivotably connected at one end to said support plate and pivotably connected at the other end to said holding portion of said heel support.

4. A safety ski binding as set forth in claim 2, wherein said connecting means includes a bracket having one end fixed to said supporting plate, and a roller rotatably mounted on the other end of said bracket, said roller engaging said sole holding portion to pivot said sole holding portion to said released position in response to movement of said heel support towards the rear end of the ski.

5. A safety ski binding as set forth in claim 2, wherein said support plate further includes a heel support lug opening extending therethrough, said connecting means including a heel support lug extending from said sole holding portion of said heel support into said heel support lug opening for contact with an edge of said heel support lug opening, said edge of said heel support lug opening and said heel support lug cooperating to pivot said heel holding portion to said release position in response to movement of said heel support towards the rear end of the ski.

6. A safety ski binding as set forth in claim 2, wherein said connecting means comprises a slide projecting from said sole plate for engagement with said sole holding portion of said heel support for pivoting said sole holding portion to said released position in response to movement of said heel support towards the rear end of the ski.

7. A safety ski binding as set forth in claim 2, wherein said connecting means comprises a lever pivotably connected at one end to said sole holding portion support, said support plate further including a lever stop for engaging the other end of said lever, said lever and said lever stop cooperating to pivot said sole holding portion to said released position in response to movement of said heel support towards the rear end of the ski.

8. A safety ski binding as set forth in claim 1,wherein said support plate includes a stop portion located at the tip end of said support plate for limiting movement of the ski boot relative to the ski.

9. A safety ski binding as set forth in claim 8, wherein said stop portion is disposed to contact the heel of a ski boot.

10. A safety ski binding as set forth in claim 8, wherein said stop portion is disposed to contact a portion of the sole proximate the toe of the ski boot.

11. A safety ski binding as set forth in claim 8, wherein said stop portion is disposed to be received in a groove in the the sole of a ski boot.

12. A safety ski binding as set forth in claim 1, further including two co-axial half axles, said sole holding portion and said bearing block pivotably connected to each other about said two half axles.

13. A safety ski binding as set forth in claim 1, wherein said spring means is an adjustable pressure spring for selectively adjusting the force between said cam roller and said cam surface.

* * * * *

UNITED STATES PATENT AND TRADEMARK OFFICE

CERTIFICATE OF CORRECTION

PATENT NO. : 4,892,326

DATED : January 9, 1990

INVENTOR(S) : JOSEF SVOBODA ET AL

It is certified that error appears in the above-identified patent and that said Letters Patent is hereby corrected as shown below:

Claim 4, column 8, line 17, "supporting" should be --support--.

Signed and Sealed this

Eighteenth Day of June, 1991

*Attest:*

*Attesting Officer*

HARRY F. MANBECK, JR.

*Commissioner of Patents and Trademarks*